US009062560B2

(12) United States Patent
Hayford et al.

(10) Patent No.: US 9,062,560 B2
(45) Date of Patent: Jun. 23, 2015

(54) GAS TURBINE ENGINE VARIABLE STATOR VANE ASSEMBLY

(75) Inventors: Richard K. Hayford, Cape Neddick, ME (US); David P. Dube, Saco, ME (US)

(73) Assignee: United Technologies Corporation, Hartford, CT (US)

( * ) Notice: Subject to any disclaimer, the term of this patent is extended or adjusted under 35 U.S.C. 154(b) by 428 days.

(21) Appl. No.: 13/418,451

(22) Filed: Mar. 13, 2012

(65) Prior Publication Data

US 2013/0243580 A1 Sep. 19, 2013

(51) Int. Cl.
*F01D 17/16* (2006.01)
*F01D 11/00* (2006.01)

(52) U.S. Cl.
CPC ..... *F01D 17/162* (2013.01); *Y10T 29/49321* (2015.01); *F05D 2300/43* (2013.01); *F01D 11/005* (2013.01)

(58) Field of Classification Search
CPC ..... F01D 17/16; F01D 17/162; F01D 11/005; F01D 9/02; F01D 9/041; F01D 9/042
USPC ..... 415/155, 160, 162, 163, 209.3, 159
See application file for complete search history.

(56) References Cited

U.S. PATENT DOCUMENTS

| | | | | |
|---|---|---|---|---|
| 4,193,738 | A | 3/1980 | Landis, Jr. et al. | |
| 4,378,961 | A | 4/1983 | Trousdell | |
| 4,883,404 | A | 11/1989 | Sherman | |
| 5,039,277 | A | 8/1991 | Naudet | |
| 6,394,750 | B1 | 5/2002 | Hiskes | |
| 7,717,670 | B2 | 5/2010 | Foucher | |
| 7,806,652 | B2 | 10/2010 | Major et al. | |
| 7,963,742 | B2 | 6/2011 | Clouse et al. | |
| 7,980,815 | B2 | 7/2011 | Cloarec | |
| 8,123,471 | B2 | 2/2012 | Mielke et al. | |
| 2007/0098548 | A1 * | 5/2007 | Barnett et al. | 415/209.3 |
| 2009/0000101 | A1 | 1/2009 | Reynolds et al. | |
| 2009/0238682 | A1 | 9/2009 | Clemen | |
| 2010/0232936 | A1 | 9/2010 | Mielke et al. | |
| 2010/0329878 | A1 | 12/2010 | Bottome et al. | |

FOREIGN PATENT DOCUMENTS

| | | |
|---|---|---|
| AT | 321224 | 6/1971 |
| EP | 1219785 | 7/2002 |
| EP | 2071136 | 6/2009 |
| EP | 2653666 | 10/2013 |
| FR | 1317759 | 5/1963 |

OTHER PUBLICATIONS

International Search Report and Written Opinion for International Application No. PCT/US2013/030099 completed Jun. 12, 2013.
International Preliminary Report on Patentability for PCT Application No. PCT/US2013/027523 mailed Sep. 25, 2014.
European Search Report for European Patent Application No. 13/761620 mailed Mar. 16, 2015.

* cited by examiner

*Primary Examiner* — Edward Look
*Assistant Examiner* — Maxime Adjagbe
(74) *Attorney, Agent, or Firm* — Carlson, Gaskey & Olds, P.C.

(57) ABSTRACT

A variable stator vane assembly for a gas turbine engine includes a variable stator vane and a non-structural fairing on the variable stator vane.

15 Claims, 6 Drawing Sheets

GAS TURBINE ENGINE VARIABLE STATOR VANE ASSEMBLY

BACKGROUND

The present disclosure relates to turbine engines, and more particularly, to a variable stator vane.

A turbine engine typically includes multiple compressor stages. Each stage includes circumferentially arranged stators positioned axially adjacent to an array of compressor blades. Some compressor stages include variable stator vanes in which the stators include trunnions that support axial rotation. The compressor section static structure may be utilized to support the outboard variable vane trunnions while a segmented split ring may be utilized to support the inboard variable vane trunnions.

In one type of variable stator vane, a leading edge of the airfoil is inset relative to the circumferences of the platforms while a trailing edge of the airfoil extends beyond, or overhangs, the platforms. The transition areas between the airfoil and the platforms may be designed to, for example, minimize stress.

One approach to minimize stress is to provide a transition fillet between the airfoil and the platforms. The fillet extends between the airfoil and each platform from the point where the airfoil trailing edge overhangs the circumference and wraps around the leading edge to the opposite side of the airfoil, terminating where the airfoil overhangs the circumference on the adjacent side. Such stator vanes may still be subject to stress in this transition area despite the use of fillets.

Another approach, which is sometimes used in combination with the above approach, is to apply a relief cut or slab-cut in the platform to interface with the trailing edge. An additional transition fillet is then applied to the slab-cut and the interfacing airfoil trailing edge. The slab-cut fillet adjoins the airfoil fillet to produce a continuous blend between the airfoil and the respective platforms.

Structural optimization balances slab-cut material removal against fillet size and trailing edge overhang. Excessive trailing edge overhang may be required for aerodynamic efficiency, but such overhang may not be conducive to structural optimization and may result in a variable vane susceptible to stress risers. These three-dimensional blends may also often only be producible by hand which may result in variation and significant manufacturing cost.

Negative aerodynamic performance effects of these fillets may include blockage in the flowpath; cavities in the flowpath caused by the flat surfaces at the leading and/or trailing edge airfoil to the platform overhang transitions; and radial gaps between the overhung airfoil and the static structure.

SUMMARY

A variable stator vane assembly for a gas turbine engine according to an exemplary aspect of the present disclosure includes, among other things, a variable stator vane and a non-structural fairing on said variable stator vane.

In a further non-limiting embodiment of the foregoing assembly, the variable stator vane may include a platform adjacent to an airfoil, and a non-structural fairing adjacent to the platform.

In a further non-limiting embodiment of either of the foregoing assembly, the non-structural fairing may surround the airfoil.

In a further non-limiting embodiment of any of the foregoing assemblies, the assembly may further include a trunnion which extends from the platform.

In a further non-limiting embodiment of any of the foregoing assemblies, the non-structural fairing may surround the airfoil opposite the trunnion.

In a further non-limiting embodiment of any of the foregoing assemblies, the airfoil may extend beyond the platform.

In a further non-limiting embodiment of any of the foregoing assemblies, the non-structural fairing may include a tab which interfaces with a flat on the platform.

In a further non-limiting embodiment of any of the foregoing assemblies, the assembly may further comprise a metal alloy sheath on the non-structural fairing.

A variable stator vane assembly for a gas turbine engine according to another exemplary aspect of the present disclosure includes, among other things, a first platform, a second platform, an airfoil between the first platform and the second platform along an axis of rotation, and a non-structural fairing which surrounds the airfoil adjacent to the first platform.

In a further non-limiting embodiment of the foregoing assembly, the assembly may further include a first trunnion which extends from the first platform and a second trunnion which extends from the second platform.

In a further non-limiting embodiment of either of the foregoing assemblies, the airfoil may extend beyond the first and second platform.

In a further non-limiting embodiment of any of the foregoing assemblies, the non-structural fairing may include a tab which interfaces with a flat on the first platform.

In a further non-limiting embodiment of any of the foregoing assemblies, the assembly may further comprise a metal alloy sheath on the non-structural fairing.

In a further non-limiting embodiment of any of the foregoing assemblies, the assembly may further comprise a metal alloy sheath on the non-structural fairing.

A method of manufacturing a variable stator vane assembly for a gas turbine engine according to another exemplary aspect of the present disclosure includes, among other things, molding a non-structural fairing onto a variable stator vane.

In a further non-limiting embodiment of the foregoing method of manufacturing a variable stator vane assembly for a gas turbine engine, the method may include molding the non-structural fairing adjacent to a platform of the variable stator vane.

In a further non-limiting embodiment of the foregoing method of manufacturing a variable stator vane assembly for a gas turbine engine, the method may include sheathing one side of the non-structural fairing.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
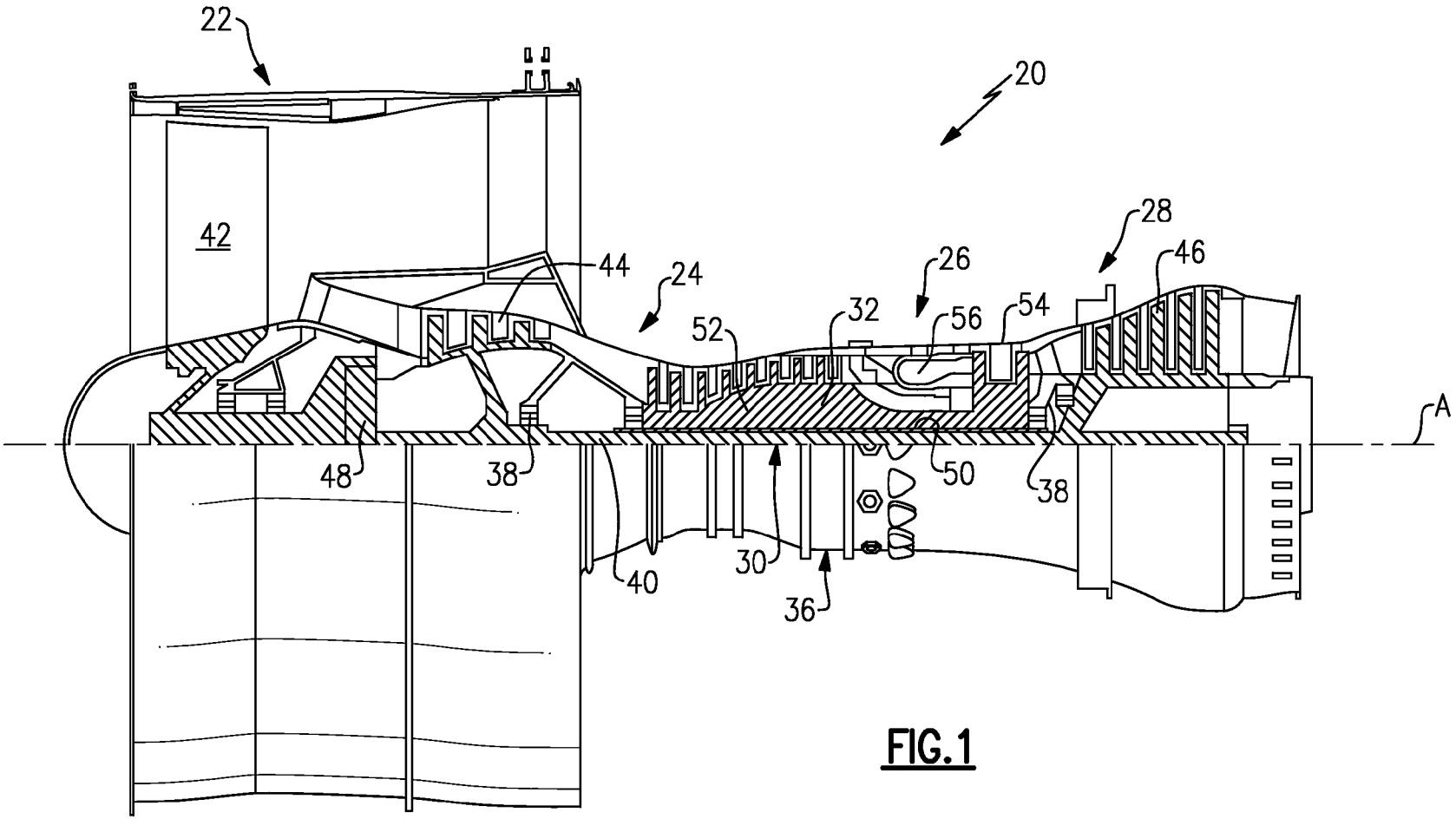
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines such as a three-spool (plus fan) engine wherein an intermediate spool includes an intermediate pressure compressor (IPC) between the LPC and HPC and an intermediate pressure turbine (IPT) between the HPT and LPT.

The engine 20 generally includes a low spool 30 and a high spool 32 mounted for rotation about an engine central longitudinal axis A relative to an engine static structure 36 via several bearing structures 38. The low spool 30 generally includes an inner shaft 40 that interconnects a fan 42, a low pressure compressor 44 ("LPC") and a low pressure turbine 46 ("LPT"). The inner shaft 40 drives the fan 42 through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

Core airflow is compressed by the low pressure compressor 44 then the high pressure compressor 52, mixed with the fuel and burned in the combustor 56, then expanded over the high pressure turbine 54 and low pressure turbine 46. The turbines 54, 46 rotationally drive the respective low spool 30 and high spool 32 in response to the expansion.

Each spool 30, 32 includes a multiple of blades 44B, 52B and a multiple of vanes 44V, 52V within each of the low pressure compressor 44 then the high pressure compressor 52. One array of blades 44B, 52B and one array of vanes 44V, 52V typically define a stage and the low pressure compressor 44 then the high pressure compressor 52 typically each include multiple stages. Oftentimes one or more stages include a variable vane which is rotatable.

Figure 2:
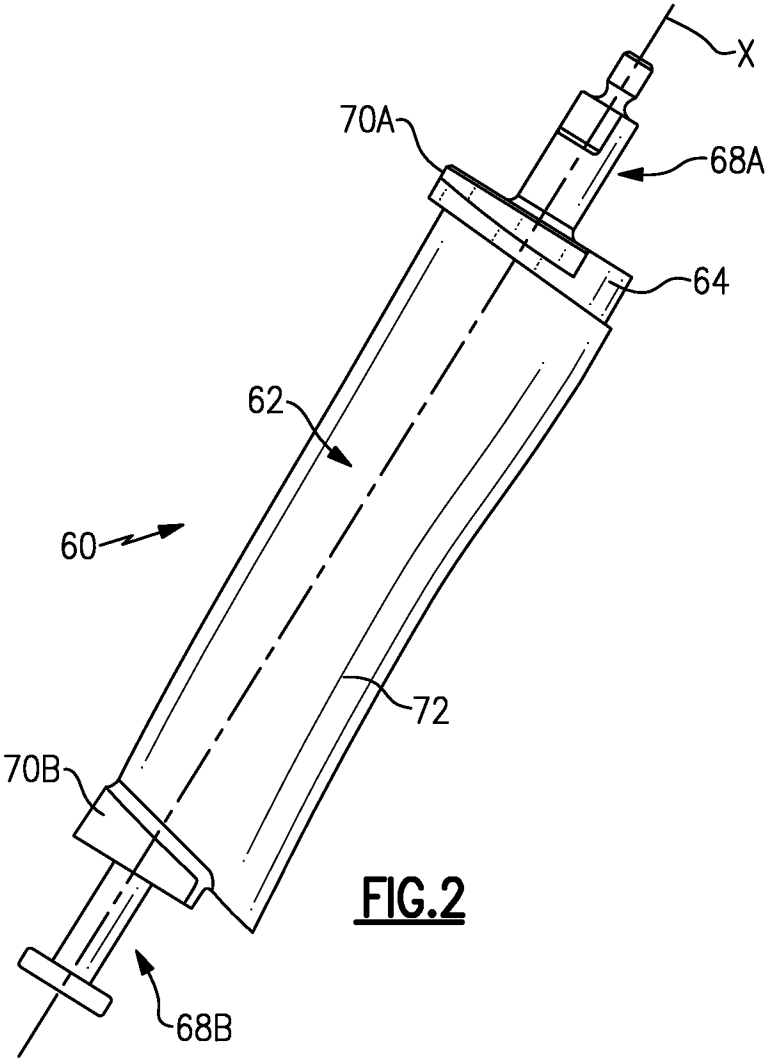
FIG. 2 is a side view of the variable stator assembly.

With reference to FIG. 2, an example variable stator vane assembly 60 is shown in more detail. It should be appreciated that the example variable stator vane assembly 60 is representative and that which is disclosed herein may be applied to the low pressure compressor 44 and the high pressure compressor 52 as well as other variable airfoil structures.

Figure 3:
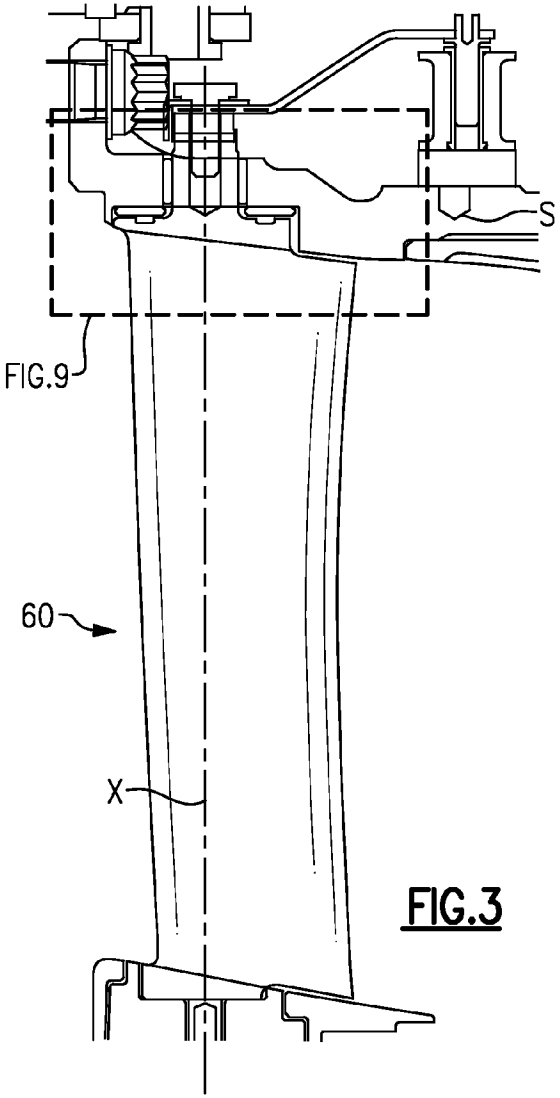
FIG. 3 is an enlarged schematic view of the variable stator assembly mounted within the engine static structure.

The variable stator vane assembly 60 generally includes a variable stator vane 62 and a non-structural fairing 64. The variable stator vane 62 is an integral member that generally includes an outer trunnion 68A, an inner trunnion 68B, an outer platform 70A, an inner platform 70B and airfoil 72 therebetween. The airfoil 72 extends between and is integral with the outer platform 70A and the inner platform 70B for rotation about a stator axis X with respect to an engine static structure S (illustrated schematically; FIG. 3).

The platforms 70A, 70B are generally cylindrical members located between the respective trunnions 68A, 68B and the airfoil 72 to define a rotational interface with respect to the engine static structure S (FIG. 3). The platforms 70A, 70B are of a greater diameter than the trunnions 68A, 68B and are coaxial therewith. It should be understood that some of the features may be used on both or only one end of the variable stator vane assembly 60.

Figure 4:
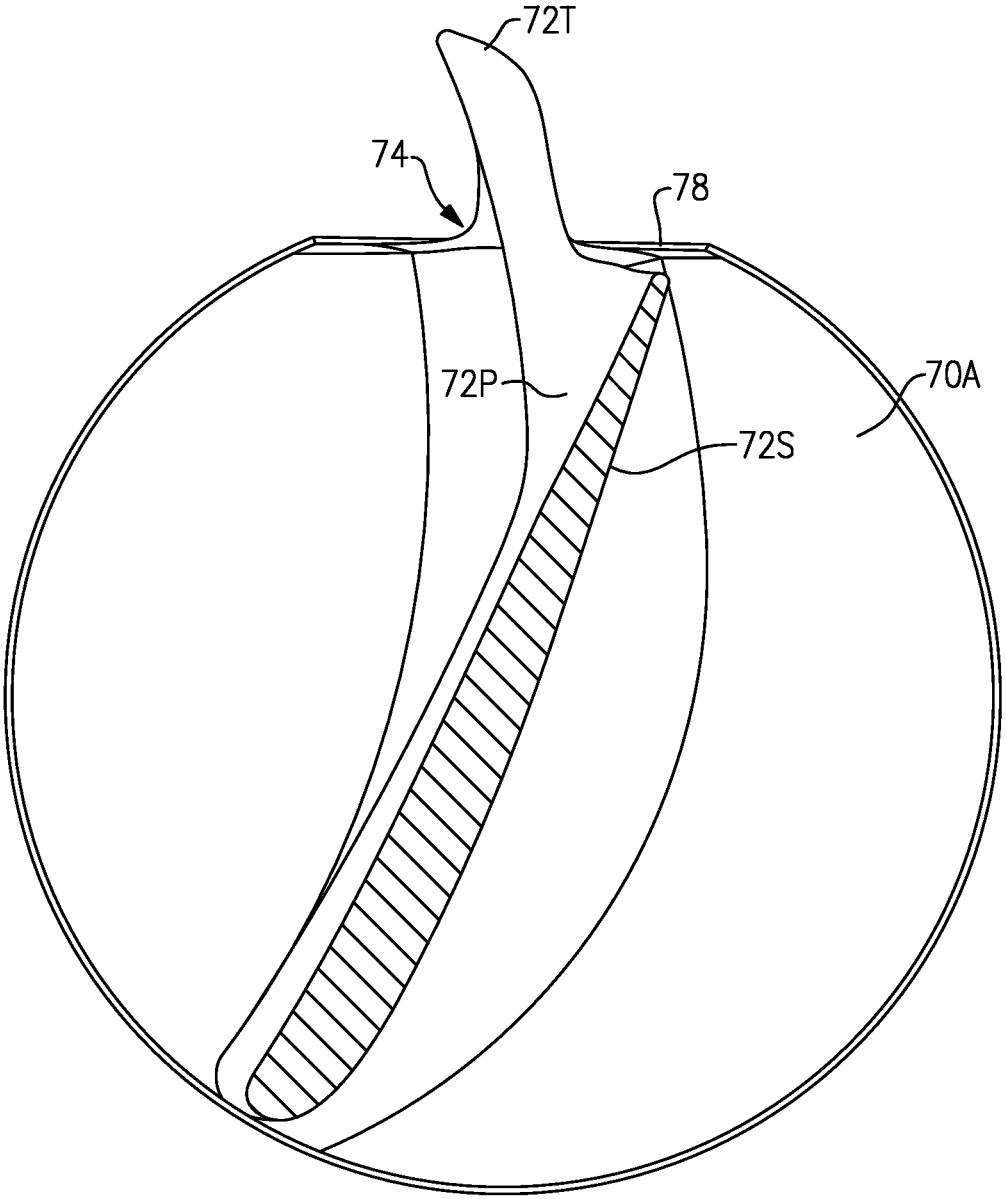
FIG. 4 is a top sectional view of the variable stator assembly.
Figure 5:
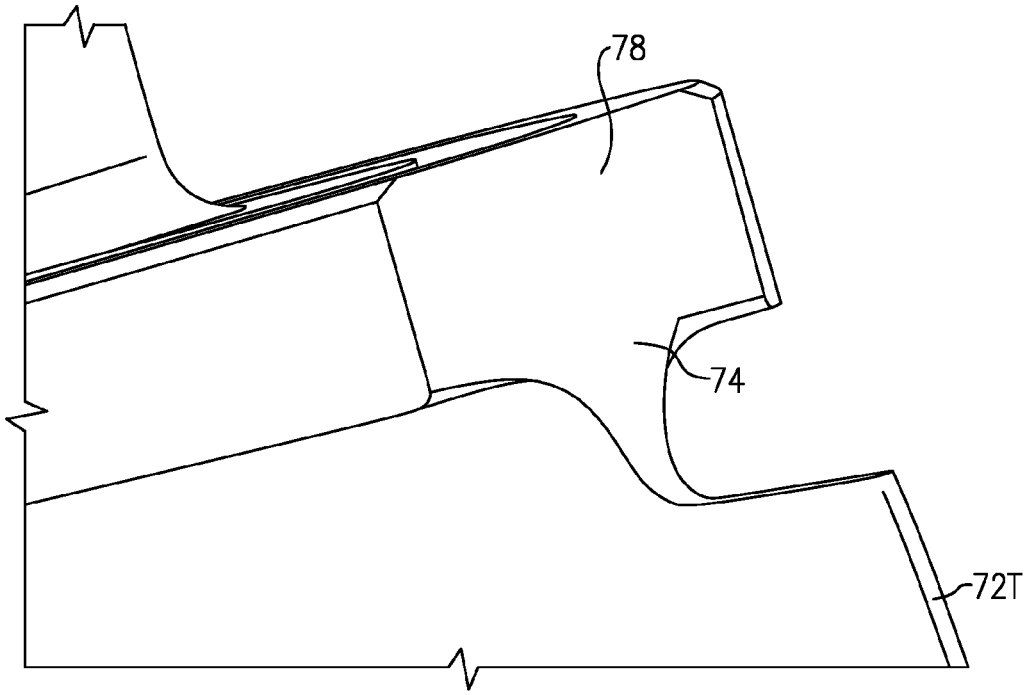
FIG. 5 is an enlarged perspective view of the variable stator without a non-structural fairing.

The airfoil 72 includes a generally concave shaped portion which forms a pressure side 72P and a generally convex shaped portion which forms a suction side 72S between a leading edge 72L and a trailing edge 72T (FIG. 4). The trailing edge 72T extends beyond the circumferences of the platforms 70A, 70B such that a blend 74 is defined between a span-wise 76 edge of the trailing edge 72T and the platform 70A at a flat 78 (FIG. 5). The flat 78 facilitates manufacturability of the variable stator vane 62 as a single integral component. As defined herein, the flat 78 may be any variation from the otherwise cylindered shape of the platform 70A. As also defined herein, the blend 74, may include one or more structural fillets between the trailing edge 72T and the flat 78.

Figure 6:
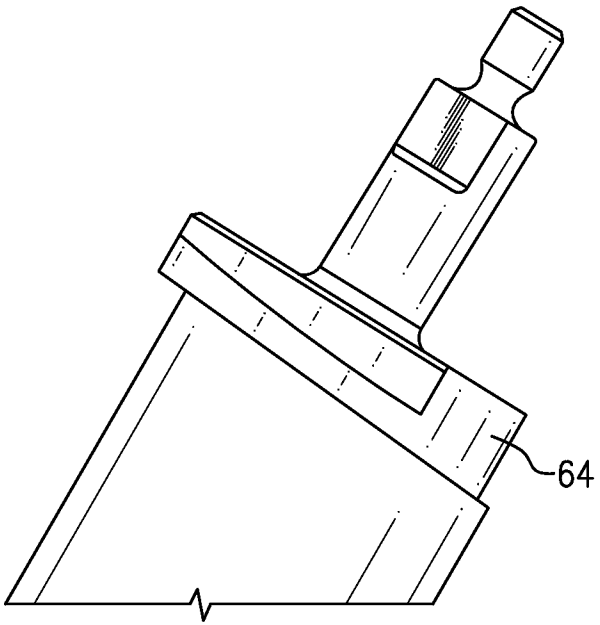
FIG. 6 is an enlarged perspective view of the variable stator with the non-structural fairing.
Figure 9:
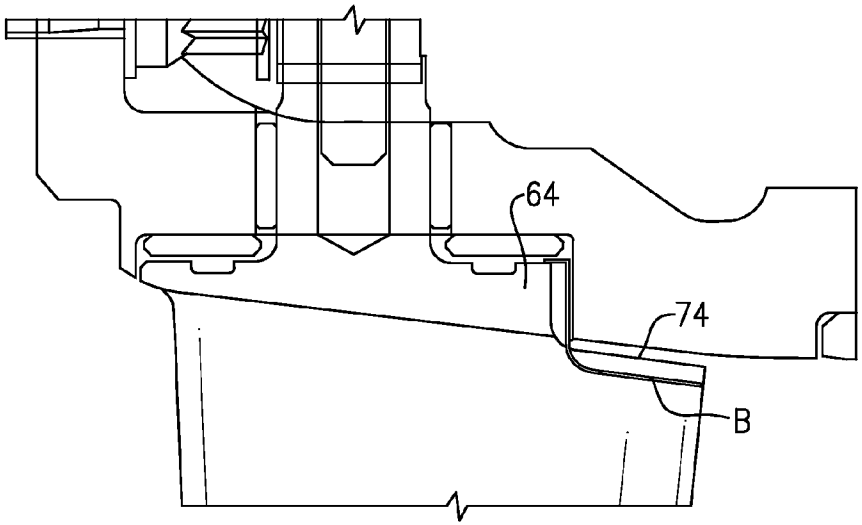
FIG. 9 is an enlarged schematic view of the variable stator assembly mounted within the engine static structure illustrating a comparison with a RELATED ART stator vane.
Figure 8:
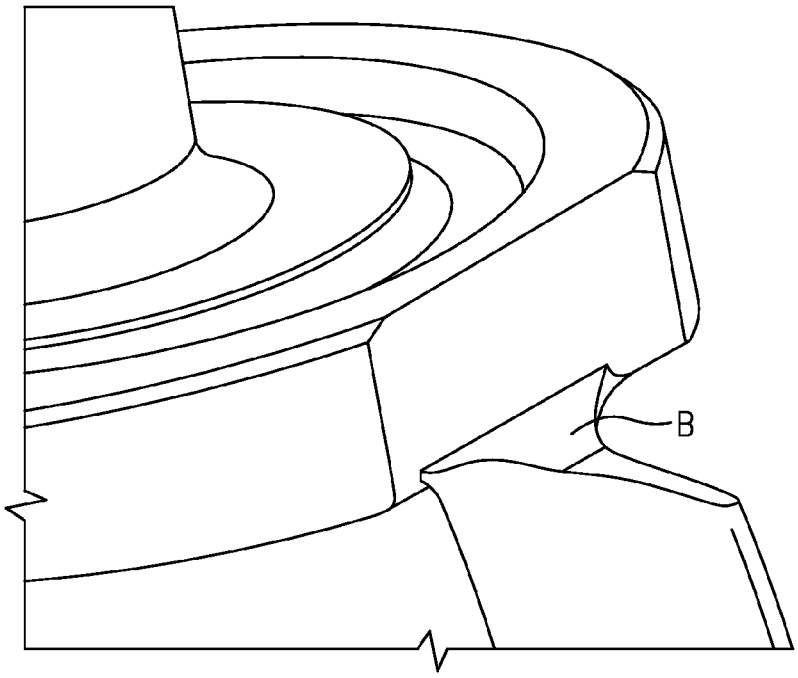
FIG.8 Related Art
FIG. 8 is an enlarged rear perspective view of a RELATED ART variable stator.
Figure 7:
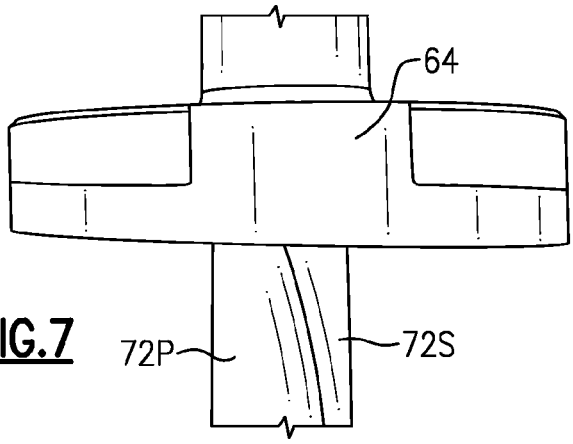
FIG. 7 is an enlarged rear perspective view of the variable stator without a non-structural fairing.

Utilization of the non-structural fairing 64 facilitates manufacture of the variable stator vane 62 as the blend 74 may be manufactured as a relatively larger structural fillet to lower stress concentration without impacting aero performance as the relatively larger structural fillet will be buried in the non-structural fairing 68 (FIGS. 6 and 7). That is, the blend 74 may be manufactured for manufacturability as compared to a conventional blend B (RELATED ART; FIG. 8) in which the fillet is a compromise between reduced stress concentration, aerodynamic losses and/or the radial gap between airfoil and the static structure S as well as manufacturability (FIG. 9).

Figure 10:
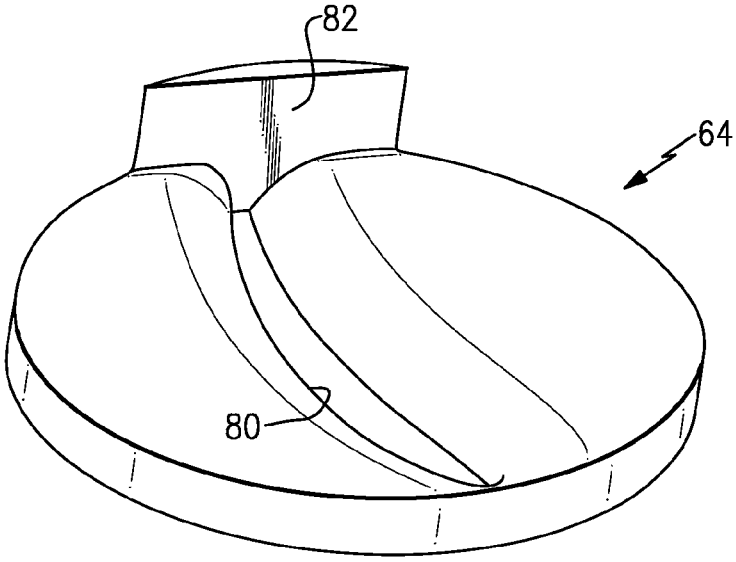
FIG. 10 is an enlarged perspective view of the non-structural fairing.

With reference to FIG. 10, the non-structural fairing 64 may be molded as a generally cylindrical member with an airfoil shaped aperture 80 and a tab 82. The airfoil shaped aperture 80 surrounds the airfoil 72 and the tab 82 interfaces with the flat 78 to minimize the radial gap between airfoil and the static structure S (FIG. 9). The non-structural fairing 64 may be manufactured of, for example, a non-metallic material such as an elastomeric polymer, silicone, fiberglass or other moldable non-structural material which may be readily molded or otherwise formed onto the variable stator vane assembly 60. The material of the non-structural fairing 64 also facilitates a damping effect to the variable stator vane assembly 60.

Figure 11:
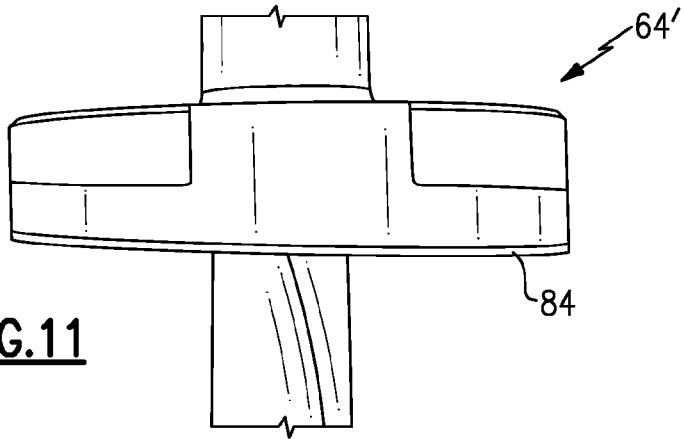
FIG. 11 is an enlarged rear perspective view of a variable stator with another disclosed non-limiting embodiment of the non-structural fairing with a sheath.

With reference to FIG. 11, in another disclosed, non-limiting embodiment, a non-structural fairing 64' includes a relatively thin metallic alloy sheath 84 which is exposed to the engine core gas path. The metallic alloy sheath 84 may be a steel alloy or nickel alloy which increases the temperature resistance of the non-structural fairing 64' and mitigates erosions.

Aerodynamic performance benefits include, for example, elimination of the structural fillets from the flowpath and their associated blockage to flow. Structural fillets may also be relatively larger to reduce stress concentrations without impact to blockage. Additional aerodynamic benefits include filling the cavity in the flowpath between the flat surfaces at leading and/or trailing edge of vane platform and adjacent static structure and reduction in the radial gap between the overhung airfoil and the adjacent static structure which otherwise occurs as a result of the three-dimensional fillet.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the invention may be practiced other than as specifically described. For that reason the appended claims should be studied to determine true scope and content.

What is claimed:

1. A variable stator vane assembly for a gas turbine engine comprising:

a variable stator vane including a platform adjacent to an airfoil, said airfoil comprises a leading edge and a trailing edge extending beyond an outer circumference of said platform;

a fillet adjacent said platform, said platform includes a flat and said fillet extends from said trailing edge to said flat; and a fairing covering said fillet, wherein said fairing comprises a generally cylindrical member with an airfoil shaped aperture and a tab, said tab configured to interface with said flat.

2. The assembly as recited in claim 1, wherein said fairing surrounds said airfoil.

3. The assembly as recited in claim 1, further comprising a trunnion which extends from said platform.

4. The assembly as recited in claim 3, wherein said fairing surrounds said airfoil opposite said trunnion.

5. The assembly as recited in claim 1, wherein said airfoil extends beyond said platform.

6. The assembly as recited in claim 1, further comprising a metal alloy sheath on said fairing.

7. A variable stator vane assembly for a gas turbine engine comprising:

a first platform, said first platform includes a flat;

a second platform;

an airfoil between said first platform and said second platform along an axis of rotation, said airfoil comprises a leading edge and a trailing edge extending beyond an outer circumference of said first platform;

a fillet adjacent said first platform, said fillet extends from said trailing edge to said flat; and a fairing which surrounds said airfoil adjacent to said first platform and covers said fillet, wherein said fairing comprises a generally cylindrical member with an airfoil shaped aperture and a tab, said tab configured to interface with said flat.

8. The assembly as recited in claim 7, further comprising a first trunnion which extends from said first platform and a second trunnion which extends from said second platform.

9. The assembly as recited in claim 7, wherein said airfoil extends beyond said first and second platform.

10. The assembly as recited in claim 7, further comprising a metal alloy sheath on said fairing.

11. A method of manufacturing a variable stator vane assembly for a gas turbine engine comprising:

molding a fairing onto a fillet of a variable stator vane; wherein said fairing comprises a generally cylindrical member with an airfoil shaped aperture and a tab, said tab configured to interface with a flat of an airfoil platform.

12. The method as recited in claim 11, further comprising: molding the fairing adjacent to a platform of the variable stator vane.

13. The method as recited in claim 11, further comprising: sheathing one side of the fairing.

14. The assembly as recited in claim 1, wherein said fairing comprises:

a non-metallic material configured to be formed onto said variable stator vane.

15. The assembly as recited in claim 1, wherein said fairing is configured to prevent said fillet from blocking fluid flow.

* * * * *